US007858859B2

(12) United States Patent
Bassam

(10) Patent No.: US 7,858,859 B2
(45) Date of Patent: Dec. 28, 2010

(54) STAND FOR A DRUM AND ALSO RELATING THERETO

(76) Inventor: Abdul-Salam Bassam, Zur Guten Hoffnung 55, D-21109 Hamburg (DE)

( * ) Notice: Subject to any disclaimer, the term of this patent is extended or adjusted under 35 U.S.C. 154(b) by 0 days.

(21) Appl. No.: 12/386,754

(22) Filed: Apr. 22, 2009

(65) Prior Publication Data

US 2009/0272250 A1 Nov. 5, 2009

(30) Foreign Application Priority Data

Apr. 28, 2008 (DE) ..... 20 2008 005 880 U

(51) Int. Cl.
*G10D 13/02* (2006.01)

(52) U.S. Cl. ..... 84/421

(58) Field of Classification Search ..... 84/421; 297/40

See application file for complete search history.

(56) References Cited

U.S. PATENT DOCUMENTS 342,062 A * 5/1886 Bemis ..... 84/421
624,662 A * 5/1899 Leedy ..... 248/187.1
1,612,148 A * 12/1926 Oettinger ..... 211/85.6
1,688,561 A * 10/1928 Straub ..... 84/411 R
2,433,594 A * 12/1947 Calo ..... 84/421
2,615,662 A 10/1952 Sannebeck
3,167,995 A * 2/1965 La Londe ..... 84/421
3,191,484 A * 6/1965 Walling ..... 84/421
3,197,789 A * 8/1965 Ashkouti et al. ..... 5/110
3,405,587 A * 10/1968 Meazzi et al. ..... 84/421
3,671,005 A * 6/1972 Schultz ..... 248/480
3,780,613 A * 12/1973 Ludwig, Jr. ..... 84/421
3,945,291 A * 3/1976 Zickos ..... 84/421
4,047,684 A * 9/1977 Kobayashi ..... 248/122.1
4,278,003 A * 7/1981 Hanson ..... 84/411 A
4,519,289 A * 5/1985 Gauger ..... 84/421
4,616,551 A * 10/1986 Bookvich ..... 84/411 A
4,779,509 A * 10/1988 Weir ..... 84/421
4,878,414 A 11/1989 Yamashita
5,309,811 A * 5/1994 Hoshino ..... 84/421
5,329,838 A * 7/1994 Yamashita ..... 84/421
5,337,645 A * 8/1994 Johnston ..... 84/421
5,404,786 A * 4/1995 Gatzen ..... 84/421
5,454,288 A * 10/1995 Hoshino ..... 84/421
5,645,253 A * 7/1997 Hoshino ..... 248/181.1
5,852,250 A * 12/1998 Cha ..... 84/327
5,949,008 A * 9/1999 Augsburger ..... 84/421
6,060,652 A * 5/2000 Lombardi ..... 84/421
6,073,999 A * 6/2000 Crane ..... 297/186

(Continued)

FOREIGN PATENT DOCUMENTS

CH 55 047 2/1911

(Continued)

*Primary Examiner*—Elvin G Enad
*Assistant Examiner*—Robert W Horn
(74) *Attorney, Agent, or Firm*—Lucas & Mercanti, LLP; Klaus P. Stoffel

(57) ABSTRACT

A drum stand with at least one leg,
at least one support region, formed as a support,
at least one foot region, formed as a foot element and
at least one holding region formed as a holding element or an accommodation element for the drum. The foot region and/or the holding region essentially extend horizontally and are connected, particularly resiliently or vibratorily, to the support region via one bend.

19 Claims, 3 Drawing Sheets

U.S. PATENT DOCUMENTS

| | | | | |
|---|---|---|---|---|
| 6,075,190 | A * | 6/2000 | Mosser et al. | 84/421 |
| 6,121,527 | A * | 9/2000 | Hamm | 84/327 |
| 6,222,107 | B1 * | 4/2001 | Lo | 84/421 |
| 6,810,705 | B1 * | 11/2004 | Leppin et al. | 72/61 |
| 7,128,368 | B2 * | 10/2006 | Sligh | 297/186 |
| 7,143,618 | B2 * | 12/2006 | Ni | 72/61 |
| 7,294,775 | B1 * | 11/2007 | Spoljaric, Jr. | 84/421 |
| 7,378,584 | B2 * | 5/2008 | Frank et al. | 84/411 R |
| 7,381,876 | B2 * | 6/2008 | Miyajima | 84/421 |
| 7,468,480 | B1 * | 12/2008 | Sikra | 84/421 |
| 7,588,228 | B2 * | 9/2009 | May | 248/436 |
| 2007/0199429 | A1 * | 8/2007 | Hsieh | 84/422.1 |
| 2009/0272250 | A1 * | 11/2009 | Bassam | 84/421 |

FOREIGN PATENT DOCUMENTS

| | | |
|---|---|---|
| DE | 92 06 877 | 7/1992 |
| DE | 44 36 039 | 2/2001 |
| DE | 195 01 312 | 12/2005 |
| GB | 2260440 | 4/1993 |
| JP | 2000 293167 | 10/2000 |
| JP | 2005 300 747 | 10/2005 |

* cited by examiner

STAND FOR A DRUM AND ALSO RELATING THERETO

BACKGROUND OF THE INVENTION

1. Field of the Invention

The present invention relates to a drum stand.

The present invention furthermore relates to a musical instrument, namely a drum.

2. Description of the Related Art

Drum stands are for the most part three-legged, wherein the foot region of the stand stands essentially vertically on the stand surface, as can be drawn for example from the published document DE 92 06 877 U1.

Further, drum stands are known for example from the published documents CH 55047 and DE 195 01 312 B4 with a vertically running stand column and three feet which can be folded out and in their use position extend away from the vertical stand column at an angle of approximately 45 degrees. The foot regions of these stands therefore stand on the stand surface at an angle of approximately 45 degrees to the horizontal.

A stand with a stand column which runs at an angle of approximately 45 degrees to the horizontal is known from the published document DE 44 36 039 C2. The foot region of this stand is formed by short foot parts arranged in extension of the stand column. To hold a large drum, this stand has an accommodation region arranged at the upper end of the stand column and a holding frame extending horizontally away from the lower end of the stand column. This holding frame is rigidly connected to the stand column.

The previously described known drum stands all have the disadvantage that the vibrations and pressure waves transmitted to the drum stand when drumming are conveyed undamped to the stand surface of the drum, which impairs the sound of the drum.

The previously described known drum stands all have the disadvantage that the vibrations of the drum shell are too strongly impeded or suppressed completely by the rigidity of the stand construction, which negatively impairs the sound of the drum.

Reference may be made to the following on the sound behavour of drums:

Many idiophonic instruments are mounted at their dead point (in the case of the bell and the cymbal, the non-vibrating center of the instrument) or the dead points (in the case of the xylophone, the two axes of the plate) in order to be able to vibrate freely. If e.g. a bell is set down, the sound ends immediately because the stand surface is rigid and suppresses the vibration of the body of the bell.

By striking a drum, one causes vibration of the head, that is to say the membrane, and indirectly of the drum body. The vibration of the shell therefore also plays a decisive role in the overall sound. That is felt clearly when one e.g. holds the drum of a drum set in one's hand and strikes it in order to thereafter play it mounted on the stand. The difference in sound is very clear and is generally found to be "poorer" when the drum is mounted. The stand types shown namely effect the damping or the suppression of the vibrations in the shell by means of their construction, because they bring the rigidity of the stand surface, on which they stand at a right angle, to the drum and more or less strongly impede or almost completely suppress the vibration of the drum body. The ideal mounting is therefore firm enough in order to hold the drum in the desired position and flexible enough in order to impair the shell vibration as little as possible. It was hitherto sought to find a transition from the rigidity of the conventional stands to the vibration of the drum by means of various spring mountings with rubber. What is novel is that in the case of these stands, this expensive transition no longer needs to be found because the stand itself already creates the transition to the rigid stand surface.

SUMMARY OF THE INVENTION

Starting from the previously mentioned disadvantages and shortcomings and also under consideration of the outlined prior art, the object of the present invention is to develop a stand of the type mentioned at the beginning as well as a drum of the type mentioned at the beginning in such a manner that the vibration of the drum body is only minimally impaired.

In accordance with the present invention, the stand is shaped in such a manner that the vibrations of the drum shell are impeded as little as possible by the stand. In the use position of the stand, the support region of the drum which is formed as a support extends upwards vertically or obliquely from the stand surface, for example from the floor. The support region is therefore arranged at least in certain areas at an angle of less than 180 degrees, preferably at an angle of approximately 40 degrees to approximately 90 degrees, to the horizontal.

To cushion the vibrations and to create a transition between the vibrating drum and the rigid stand surface, the connection of the support region with

- the essentially horizontally extending foot region of the stand and/or
- the essentially horizontally extending holding region of the stand is formed as at least one elastic, particularly resilient or vibrating bend. The bend between the support region and foot region and/or between the support region and holding region therefore (in each case) forms a rotational axis about which the foot region and/or the holding region elastically moves, or more specifically vibrates. On account of its structural configuration, the stand is thus similar to the cantilever chair which is known as seating furniture.

The vibrations generated by the drum during actuation are accommodated by the stand or by the vibration stand without these vibrations and pressure waves being conveyed onto the stand surface. Thereby, even in the case of smaller drums, a unique soft playing feel results, which can only be compared with large, expensive ethnic drums from Africa and Asia.

The free vibration of the drum shell is only minimally impeded by the stand or by the vibration stand, as the stand or vibration stand does not directly bring the rigidity of the stand surface to the shell. Thereby, even in the case of smaller drums, a unique soft playing feel results, which can only be compared with drums which are carried directly on the body, e.g. bass and snare drums in marching music, djembe and djun-djun in African music.

In order to allow a good damping and, at the same time, a good strength of the stand, the foot region is preferably arranged under the drum shell in the manner of a runner. While, for the purpose of maintaining a high strength, the foot region preferably extends underneath the entire drum body, that is to say the length of the foot region essentially corresponds to the diameter of the drum shell, the holding region can be configured to clearly be shorter.

In order to allow a good influence on the vibration behavour of the shell and, at the same time, a good strength of the stand, the foot region is preferably arranged under the drum shell in the manner of a runner. Three felt or rubber or resiliently elastic plastic elements can also preferably be used in order to prevent wobbling on an uneven stand surface caused by three-point bearing. While, for the purpose of maintaining a high strength, the foot region preferably extends underneath the entire drum body, that is to say the length of the foot region essentially corresponds to the diameter of the drum shell, the holding region can be configured to clearly be shorter.

A particularly good damping and a particularly good influence on the vibration of the shell results when both the holding region and the foot region of the stand leg essentially extend horizontally and are connected, particularly resiliently or vibratorily, to the support region via one bend in each case. In this case, the holding region preferably runs parallel to the foot region. For example, the leg of the drum stand can be formed to be U-shaped, wherein the holding region and the foot region respectively form the sides of the U. Alternatively, the holding region can also be arranged obliquely to the foot region or be formed in a circular or arc-shaped manner, however. Embodiments with only an L-profile and a somewhat modified stand surface, e.g. as a cross, are also possible.

The stand can for example be produced from wood, plastic or from metal or another suitable material. On account of its structural configuration, there are no risks of injury for the user of the stand. In contrast with this, the user can pinch or knock themselves when using conventional metal stands, as they are known from the published documents CH 55047 and DE 195 01 312 B4.

A further advantage of the drum stand according to the invention is that it can be stacked and thus only requires a fraction of the space of conventional drum stands. For space saving during transporting and storage, the drum stand can also consist of a plurality of sections. For example, the drum stand can have

- a first section formed from support region and foot region and
- a second section formed from support region and holding region.

The individual sections can be releasably connected to one another by means of a connection element, for example by means of a screw connection.

In accordance with a preferred embodiment of the present invention, at least one clamping ring, particularly at least one tuning ring, is shaped to the drum in such a manner that it projects slightly, preferably approximately 2 mm, beyond the shell edge of the drum. In the case of this configuration, the shell edge is protected by the clamping ring from damage when the shell edge is struck intentionally or unintentionally, for example as a tone color.

The present invention finally relates to the use of at least one drum in accordance with the previously presented type for use in the fitness sector.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
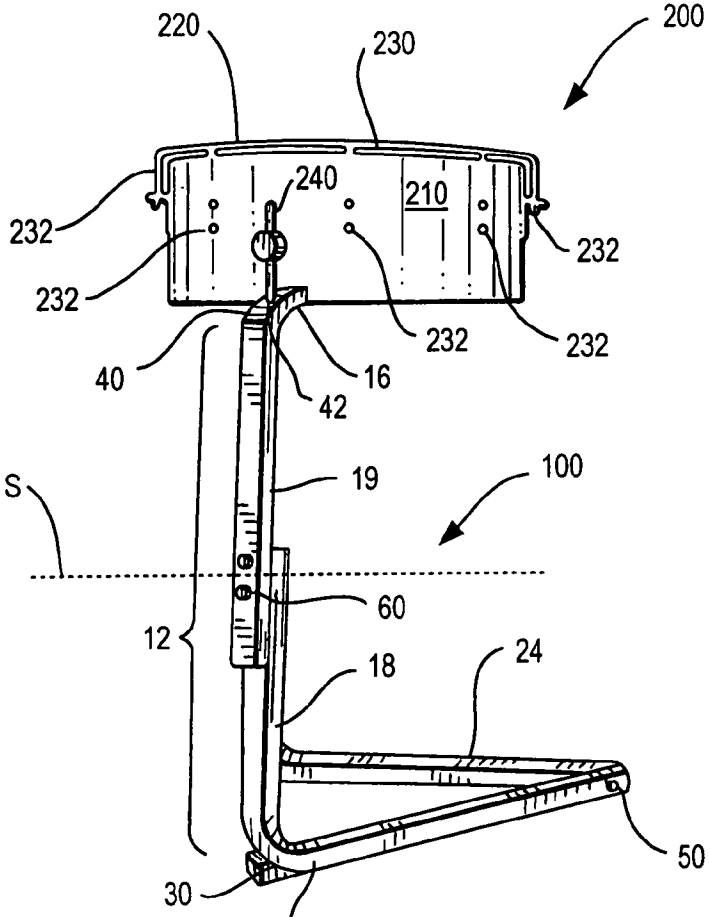
FIG. 1 is a perspective side view of an exemplary embodiment of a drum in accordance with the present invention with a vibration stand in accordance with the present invention.

FIG. 1 shows a stand, namely a vibration stand 100, for a drum 200. The vibration stand 100 can be used for holding very different kinds of drums. For example, the vibration stand 100 can be used for holding a snare drum with flat cylindrical body made out of metal and snares on the lower head. Further, a snare or field drum can be held by the vibration stand 100. Finally, the vibration stand can also be used to hold large drums such as tambourines, tom-toms, bongos and congas.

The vibration stand 100 has one or two legs with in each case

- a support region 12, 22, formed as a support,
- a foot region 14, 24, formed as a foot element and
- a holding region 16, 26 formed as a holding element or an accommodation element for the drum 200.

The foot region 14, 24 extends in the manner of a runner under the drum shell 210 and is resiliently or vibratorily connected to the vertically arranged support region 12, 22 via a bend 30. Further, the support region 12, 22 is connected resiliently or vibratorily with the horizontally extending holding region 16, 26 via a bend 40. These two bends 30, 40 are arranged mirror-symmetrically about a mirror axis S which runs essentially horizontally and/or parallel to the drum membrane 220.

The legs are constructed in one or two pieces, wherein the individual sections 18, 19, 28, 29 of the legs are releasably connected to one another by means of at least one screw connection 60. A first section 18 or 28 of the relevant leg consists of the support region 12 or 22 and the foot region 14 or 24. The second section 19 or 29 of the relevant leg consists of the support region 12 or 22 and the holding region 16 or 26. To increase the stability, the individual sections 18, 19 or 28, 29 are in each case constructed in one piece.

Figure 4:
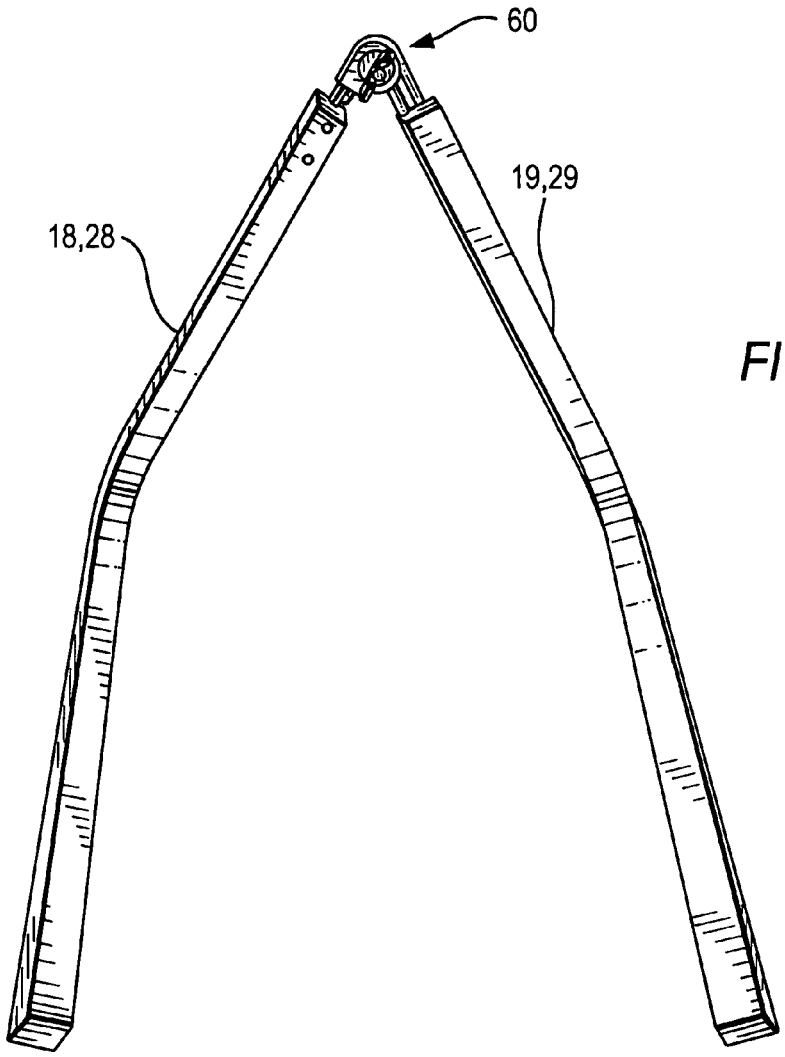
FIG. 4 is a diagrammatic view of a leg constructed in two-pieces, with sections connected to one another by means of a releasable connection, in the open position.
Figure 5:
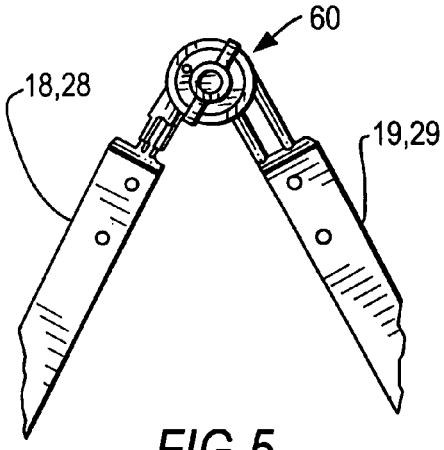
FIG. 5 is a perspective view of the connecting region of the two sections of the two-part leg.
Figure 6:
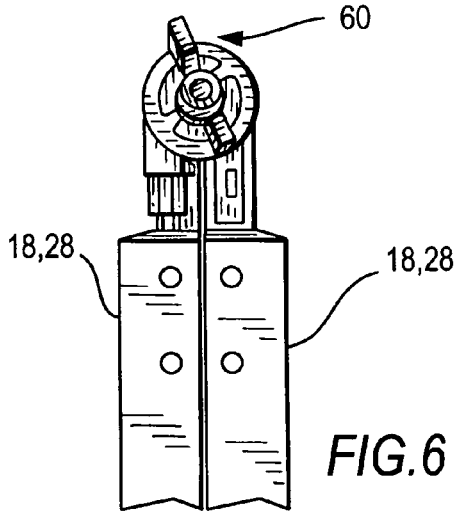
FIG. 6 is a perspective view of the connecting region of the two sections of the two-part leg in the folded position.

In the use position of the stand 100, the ends of the foot regions 14, 24 facing away from the support region 12 or 22 are releasably connected to one another by means of at least one screw connection 50. The connection 50 can also be a screw connection, with which the angle of the two holding arms can be set at from 0° to 180° or even more. The 0° position would be for transporting and storage, all of the others can be set for drums of various diameters (FIGS. 4 to 6). The holding regions 16, 26 are, by contrast arranged at a distance from one another. This particular arrangement imparts to the stand 100 a high degree of strength and high degree of stability. Otherwise formed releasable connections 50 can also be used, such as e.g. settable pivot joints with locking devices.

To attach the drum shell 210, the bend 40 has a vertically running hole 42 between the support region 12, 22 and holding region 16, 26. A holding element 240 fixed to the outer edge of the drum shell 210 is mounted in this hole 42.

The drum shell 210 extends horizontally away from the holding regions 16, 26, wherein the holding regions 16, 26 are arranged at the outer circumference of the cylindrical drum shell 210.

A drum membrane 220 mounted at the upper edge of the drum shell 210 is held by at least one clamping ring or tuning ring 230. To protect the shell edge from mechanical damage, this tuning ring 230 projects approximately 2 mm beyond the shell edge or rests on the shell edge.

To fix the clamping ring 230, the drum has approximately nine clamping elements 232 or tuning screws arranged at the outer circumference of the drum shell 210.

The drum head 220 is constructed such that, in spite of a multiplicity of drummers and full bodily engagement, for example in the case of drumming in the fitness sector, the sound produced is not too loud, but rather is pleasant. The drum head 220 thus does not generate any frequencies that are perceived as noise. Rather, the drum head 220 is chosen in such a manner that only one guttural, earthy sound is formed, which has more in common with a boxing strike on a punch bag than with a drum. The drum head 220 is also chosen in such a manner that little resonance is produced.

The drumsticks used are preferably those which can be held with the whole hand and do not cause too much wear on the head.

Figure 2:
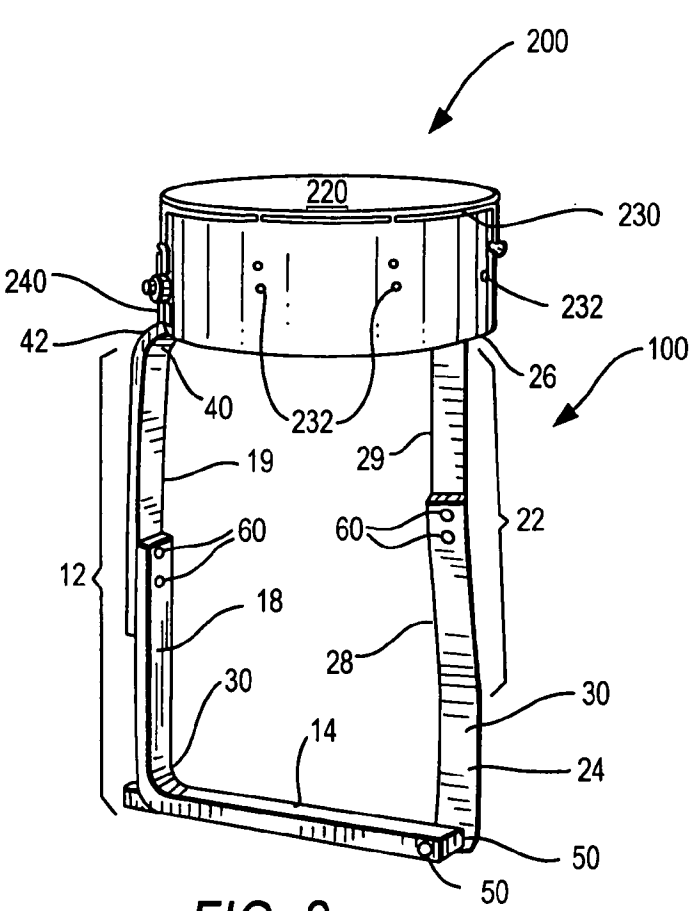
FIG. 2 is a perspective front left view onto the drum as well as the vibration stand of FIG. 1.
Figure 3:
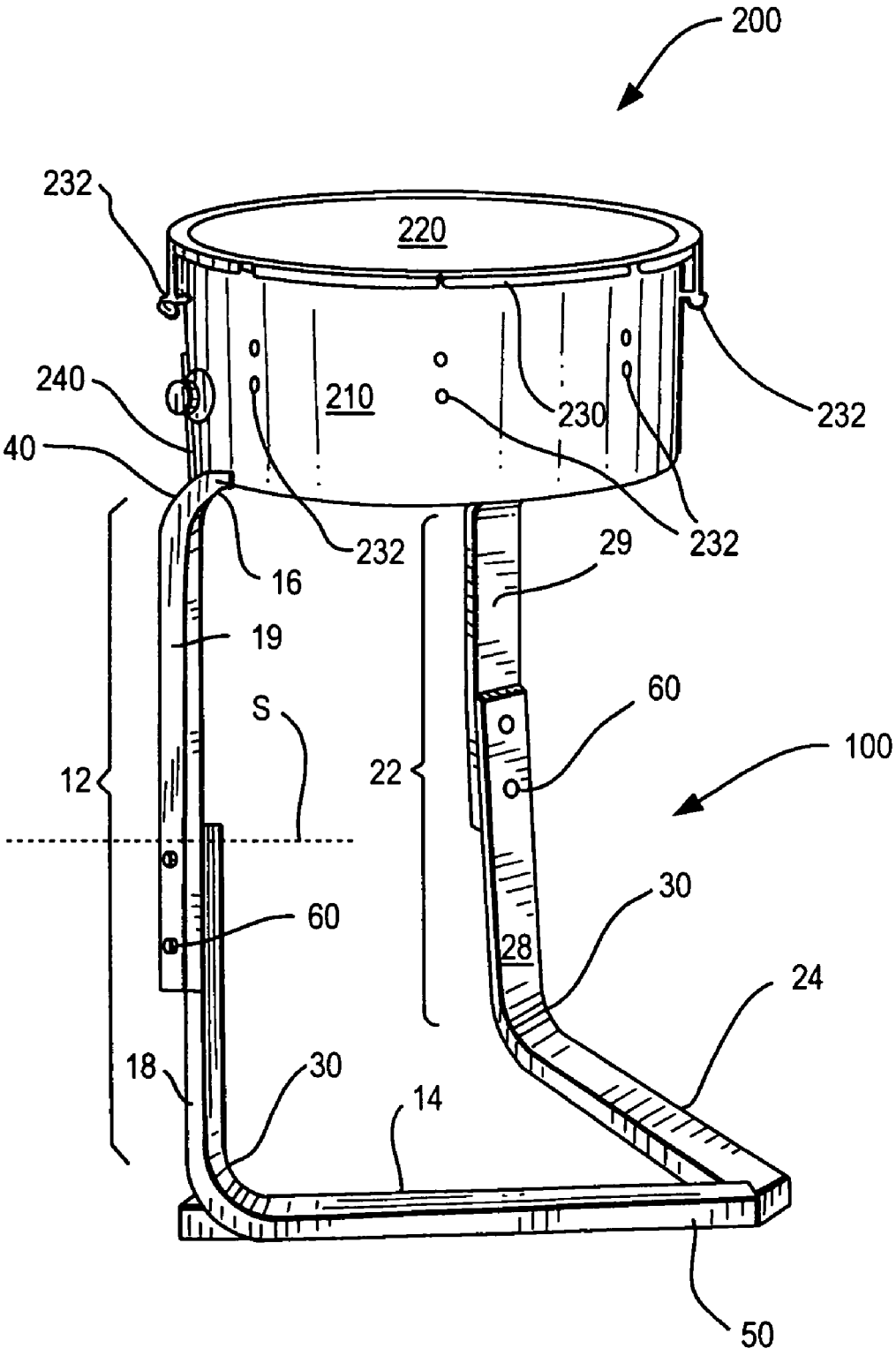
FIG. 3 is another perspective view from front left onto the drum as well as the vibration stand of FIG. 1.

The drum 200 shown in the FIGS. 1 to 3 with the vibration stand 100 differs from drums known from the prior art by means of a uniquely soft playing feel.

Further advantages with respect to the prior art are the stackability and the good transportability of the instrument as well as the prevention, thanks to the design, of the risks of injury of a conventional metal stand.

The vibration stand 100 shown in the FIGS. 1 to 3 is particularly suitable for drums 200 used in fitness studios, at events or in therapies. The vibration stand 100 is therefore particularly suitable in areas, in which many vibrations and pressure waves are applied to the stand.

While specific embodiments of the invention have been shown and described in detail to illustrate the inventive principles, it will be understood that the invention may be embodied otherwise without departing from such principles.

I claim:

1. A stand for a drum, wherein the stand comprises at least one leg with at least one support region, formed as a support, at least one foot region, formed as a foot element and at least one holding region formed as a holding element or an accommodation element for the drum, wherein the foot region and the holding region essentially extend horizontally and are each connected resiliently or vibratorily to the support region via a respective single bend, wherein the bend between the support region and the foot region, and the bend between the support region and holding region are each arranged mirror-symmetrically about a mirror axis which runs essentially horizontally.

2. The stand according to claim 1, wherein at least one part of the support region is constructed in one piece with the foot region or at least one part of the support region is constructed in one piece with the holding region.

3. The stand according to claim 1, wherein the support region and the foot region or and/or the support region and the holding region are arranged at an angle of less than 180 degrees to one another.

4. The stand according to claim 3, with the angle is less than or equal to approximately 90 degrees.

5. The stand according to claim 1, wherein the support region extends vertically at least in certain areas.

6. The stand according to claim 1, wherein the leg has a first section, formed from the support region and from the foot region and a second section, formed from the support region and from the holding region, further comprising at least one connecting element for connecting the first section and the second section to one another connecting element.

7. The stand according to claim 6, wherein the connecting element is a screw connection.

8. The stand according to claim 1, comprising at least one leg.

9. The stand according to claim 8, including a second foot region, wherein in a use position of the stand, the foot regions are in contact with one another.

10. The stand according to claim 9, wherein, in a use position of the stand, the ends of the foot regions facing away from the support region, are connected to one another by means of at least one connecting element, by means of at least one screw connection.

11. The stand according to claim 1, wherein the bend between the support region and holding region has at least one vertically running recess.

12. The stand according to claim 1, wherein at least one part of the support region is constructed in one piece with the foot region and at least one part of the support region is constructed in one piece with the holding region.

13. The stand according to claim 1, wherein the support region and the foot region and the support region and the holding region are arranged at an angle of less than 180 degrees to one another.

14. A drum with an essentially cylindrical and, essentially horizontally arranged drum shell, at least one drum membrane mounted at an upper edge of the drum shell and at least one stand having at least one leg with at least one support region, formed as a support, at least one foot region, formed as a foot element and at least one holding region formed as a holding element or an accommodation element for the drum, wherein the foot region and the holding region essentially extend horizontally and are each connected resiliently or vibratorily to the support region via a respective single bend, wherein the bend between the support region and the foot region, and the bend between the support region and holding region are each arranged mirror-symmetrically about a mirror axis which runs essentially horizontally.

15. The drum according to claim 14, comprising at least one clamping device with at least one clamping ring for mounting the drum membrane, and at least one clamping element, for fixing the clamping ring to the drum shell, wherein the clamping ring is, in the use position, arranged over or on the edge of the drum shell.

16. The drum according to claim 14, wherein in the use position of the drum the foot region is arranged in the manner of a runner under the drum membrane or the drum membrane is arranged essentially parallel over the foot region.

17. The drum according to claim 14, wherein the end of the holding region facing away from the support region lies on the outer circumference of the drum shell in the use position.

18. The drum according to claim 14, comprising at least one holding element is arranged at the drum shell which can be mounted in a recess arranged between the support region and holding region.

19. The drum according to claim 14, wherein in the use position of the drum the foot region is arranged in the manner of a runner under the drum membrane and the drum membrane is arranged essentially parallel over the foot region.

* * * * *